US009120535B1

(12) United States Patent
Remnant

(10) Patent No.: US 9,120,535 B1
(45) Date of Patent: Sep. 1, 2015

(54) WAKE ENHANCING METHOD AND APPARATUS

(71) Applicant: Wayne Remnant, Collingwood (CA)

(72) Inventor: Wayne Remnant, Collingwood (CA)

(73) Assignee: Square One Distribution Co., Inc., Issaquah, WA (US)

( * ) Notice: Subject to any disclaimer, the term of this patent is extended or adjusted under 35 U.S.C. 154(b) by 53 days.

(21) Appl. No.: 13/986,817

(22) Filed: Jun. 10, 2013

Related U.S. Application Data

(60) Provisional application No. 61/689,748, filed on Jun. 13, 2012.

(51) Int. Cl.

| | |
|---|---|
| ***B63B 43/06*** | (2006.01) |
| ***B63B 1/32*** | (2006.01) |
| *B63B 35/85* | (2006.01) |

(52) U.S. Cl.
CPC ..... *B63B 1/32* (2013.01); *B63B 2035/855* (2013.01)

(58) Field of Classification Search
CPC ..... B65D 31/02; B63B 2035/855
USPC ..... 114/121–125; 383/113
See application file for complete search history.

(56) References Cited

U.S. PATENT DOCUMENTS

| | | | | |
|---|---|---|---|---|
| 4,998,496 | A * | 3/1991 | Shaw, III | 114/222 |
| 5,787,835 | A * | 8/1998 | Remnant | 114/271 |
| 6,029,595 | A * | 2/2000 | Bachmann | 114/125 |
| 6,675,998 | B2 * | 1/2004 | Forsman et al. | 224/148.2 |
| 2009/0304308 | A1 * | 12/2009 | Townsend et al. | 383/24 |

OTHER PUBLICATIONS

"Rule Pumps Non-Automatic 12 Volt DC Bilge Pump, 360 GPH, 24 (D)", located at http://store.waterpumpsupply.com/rule1.html, published Apr. 27, 2011, retrieved via WaybackMachine on Feb. 4, 2014.*

* cited by examiner

*Primary Examiner* — S. Joseph Morano
*Assistant Examiner* — Andrew Polay
(74) *Attorney, Agent, or Firm* — Law Firm of Walter D. Ames

(57) ABSTRACT

A method and apparatus for emptying liquid from a flexible, portable bladder that enhances the wake of a boat, including locating a submersible pump within the bladder and activating the pump to evacuate liquid from the bladder.

6 Claims, 3 Drawing Sheets

WAKE ENHANCING METHOD AND APPARATUS

I. CROSS-REFERENCE TO RELATED APPLICATION

This application claims priority under 35 U.S.C. 119(c) based on U.S. Provisional Patent Application Ser. No. 61/689,748, filed Jun. 13, 2012, which is incorporated herein by reference for all purposes.

II. FIELD OF THE INVENTION

The present invention relates generally to apparatus adapted to be located in a boat to alter the operational characteristics of the boat. More specifically, it relates to apparatus that has a substantial weight so that it can markedly increase the wake of the vessel during operation, thereby creating a greater challenge for water skiers, wakeboarders, and wakesurfers who utilize the wake created during motion of the boat to perform acrobatic maneuvers.

III. BACKGROUND OF THE INVENTION

Water sports are now well known in which the wake created by a boat moving through a body of water is utilized to create a substantive challenge to those who use the wake a source of energy that enables them to perform acrobatic stunts. So, a wakeboarder, or wakesurfer, or wakeskier who trails a boat to which he is tethered by a line, leaps over the boat's wake or is impelled by that wake as the boat drives through a body of water. As might be anticipated, the degree of difficulty in performing acrobatic maneuvers is increased when the wake is greater, but the energy to perform stunts is increased and, particularly at a contest where acrobatic ability is being judged, the more turbulent the wake, the greater the degree of difficulty in mastering it and the higher the subsequent reward. Thus, apparatus that cause a craft to create a greater wake are in demand by those who engage in challenging water sports.

Different types of weights have been placed in the boat in order to increase the wake created by the boat as it cruises through a body of water. Most weights have obvious detrimental characteristics. For example, placing several hundred pounds of concrete blocks in the boat may increase the wake, but moving hundreds of pounds of anything into aft position is a strenuous undertaking, and any misstep may result in severe damage to the structure of the vessel as well as to person who is attempting to position the weights. Removal of the weights from the boat after usage is equally tiring, and dangerous.

The device described and claimed in my U.S. Pat. No. 5,787,835, which issued on Aug. 4, 1998 and is entitled, Wake Enhancing Structure, constituted a step forward in the art of increasing the wake of a vessel by the placement of weight aft of the hull. Its disclosure is incorporated herein by reference where necessary. My patented invention, which has been commercially successful, comprised locating a liquid impermeable bladder in the boat. The interior of the bladder was accessed by utilization of a nozzle or other means so that liquid, usually water, could be pumped into or out of the bladder. In this manner an empty bladder, which often included a protective sheath and was relatively light in weight, could easily be transported to the dock and located in aft position on a boat. The bladder was then filled with water, which added markedly to the weight of the boat and substantially increased the wake created by the boat. After the trip had been completed, water could be permitted to drain from the bladder into the lake or other reservoir, often by means of a hose attached at one end to a nozzle on the bladder with the other hose end extending over the side of the boat. If emptying the bladder water into a reservoir was inconvenient, it could be discharged into the bilge of the boat for later discharge therefrom. An empty bladder can then easily be removed from the boat to a locker or other storage facility.

While my invention described in the '835 patent has achieved a degree of commercial success, a deficiency that has been noted is the length of time necessary to empty the bladder prior to removing it from the boat, as well as the lack of ease in the emptying procedure. In order to improve the speed of water removal, either a siphoning hose or a pump may be used. As stated, conventional bladders have one or more nozzles that are the means to gain access to the bladder water. To empty the bladder with a pump, an external, in-line pump is used to draw/suction liquid through the nozzle fitting in the bladder. To empty the bladder using a siphon, a hose is attached to a bladder nozzle. However, the hose must be located with its free end below the water level in the bladder or siphoning will stop. When either siphoning or pumping is employed, draining the bladder will cease if air is permitted to enter the system. Further, an excessive length of time is necessary for complete discharge of liquid from the bladder.

It is, therefore, a primary object of the present invention to provide an apparatus and method whereby water can be removed more quickly and efficiently from the bladder of a wake enhancing structure than those previously employed: siphoning or use of an external, in-line pump.

IV. SUMMARY OF THE INVENTION

In order to effect more rapid and efficient emptying of the bladder after usage to create a more vigorous wake, the bladder is formed with a relatively wide opening at the top portion thereof. When bladder emptying is desired, the relatively large opening formed at the top of the bladder is opened and a submersible pump is inserted through the opening into the interior of the bladder, where it is completely covered with the water in the interior of the bladder. The submersible pump is then operated to remove all or almost all of the water in the bladder. After the bladder has been emptied, the pump is then removed from the bladder interior, usually manually, and the bladder folded or otherwise compressed for storage. A similar method may also be used to fill the bladder by opening the empty bladder, inserting the pump hose into the bladder, and placing the submersible pump in the lake or body of water, and then pumping water from the lake or other body of water in which the boat is floating, or other water source, directly into the bladder until it has been filled.

It will be apparent that practice of the method summarized above is dependent on altering the structure of the bladder as that bladder has been described in a preferred embodiment of the invention of my U.S. Pat. No. 5,787,835. There nozzles are utilized to fill and empty the bladder. In the invention to which the present patent application is directed, an opening must be provided in the bladder of sufficient size that a pump of the proper capacity can be installed within, and then, if desired, removed from the bladder. The structure of the bladder to provide an opening in the top thereof can be accomplished in many ways, and one such structure, which is presently preferred, is illustrated in the accompanying drawings, to which reference is now made.

V. DESCRIPTION OF DRAWINGS

VI. DETAILED DESCRIPTION OF EMBODIMENT

Figure 3:
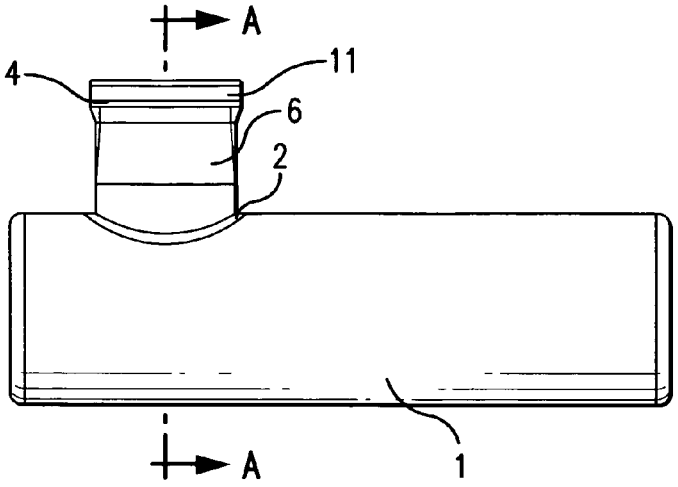
FIG. 3 is a side elevational view of the preferred embodiment of FIG. 1, with the sleeve in closed position.
Figure 3A:
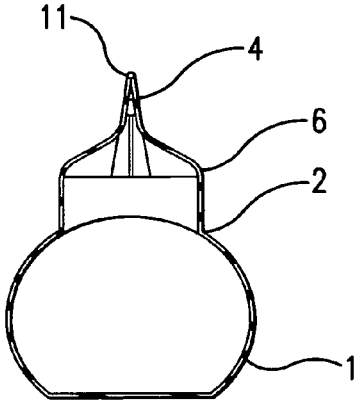
FIG. 3A is a sectional view in the direction of the arrows A-A of FIG. 3.
Figure 4:
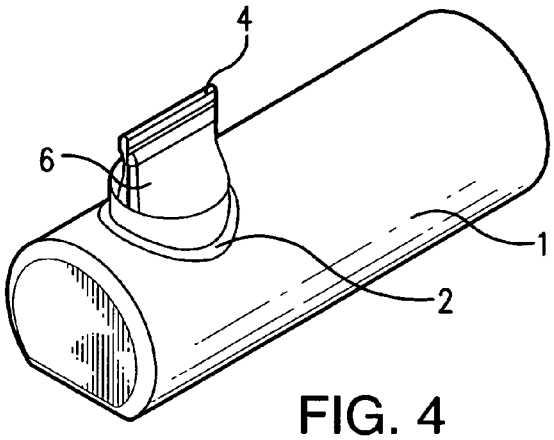
FIG. 4 is a perspective view of the embodiment of FIG. 3.

Referring now to the drawings, and in particular to FIGS. 1, 1B, 2 and 5 thereof, in sleeve-open position the preferred embodiment comprises an elongated bladder 1 that is adapted to hold a liquid 7, which is preferably water. Conveniently, the bladder 1 may be cylindrical in overall appearance and is water-tight. Access to the interior of the bladder is limited to a port 10 formed in the upper wall portion of the bladder. While there are many different means through which an access port can be formed to gain access to the interior of the bladder, at present my preferred embodiment thereof is that the port, indicated generally by the numeral 10, is formed in an upper portion of the bladder. Mounted around the port 10 is a sleeve that is illustrated in open position in FIGS. 1, 1B, 2 and 5, and in closed position in FIGS. 3, 3A and 4. The sleeve 5 is maintained in its position at the port 10 formed in the resilient bladder 1 by means of a flange 2 that extends around the port opening and adds stiffness to the otherwise resilient body of the bladder. As shown in FIGS. 1, 1B, 2 and 5, the sleeve 5 is foldable upon itself. However, in the open position there illustrated the sleeve 5 provides ready access to the interior of the bladder. When folded upon itself, the sleeve 5 forms a complete closure of the bladder 1, as is seen in FIGS. 3, 3A and 4. In its closed position there shown, the sleeve provides a water impermeable seal so that whatever liquid is contained within the bladder will remain in such confined location.

Figure 1:
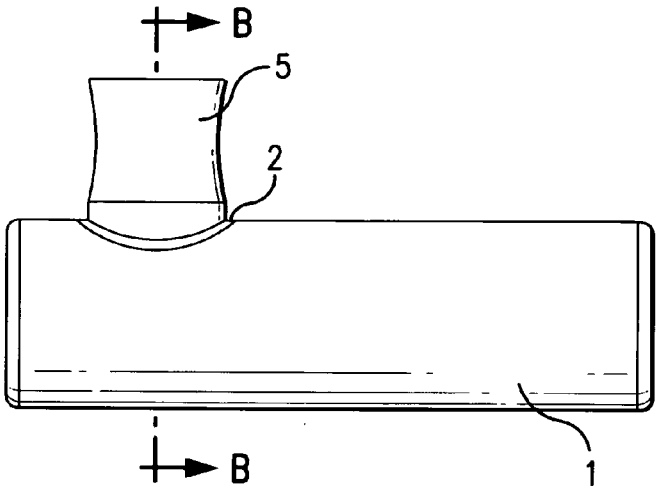
FIG. 1 is a side elevational view of a preferred embodiment of a bladder according to my invention, with the sleeve in open position.
Figure 1B:
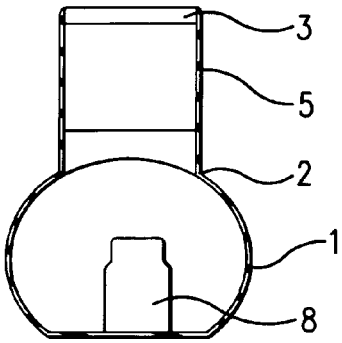
FIG. 1B is a sectional view in the direction of the arrows B-B of FIG. 1.
Figure 2:
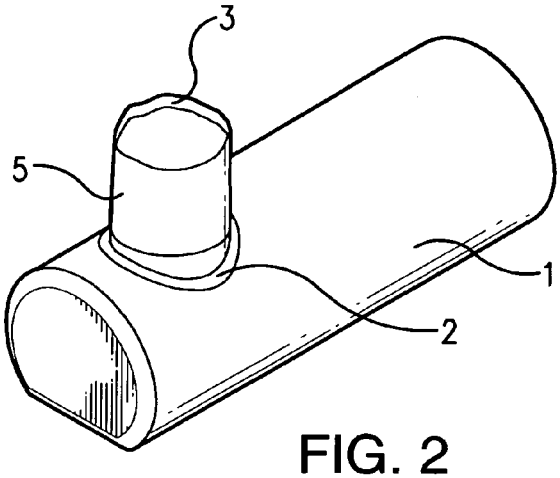
FIG. 2 is a perspective view of the embodiment of FIG. 1.
Figure 5:
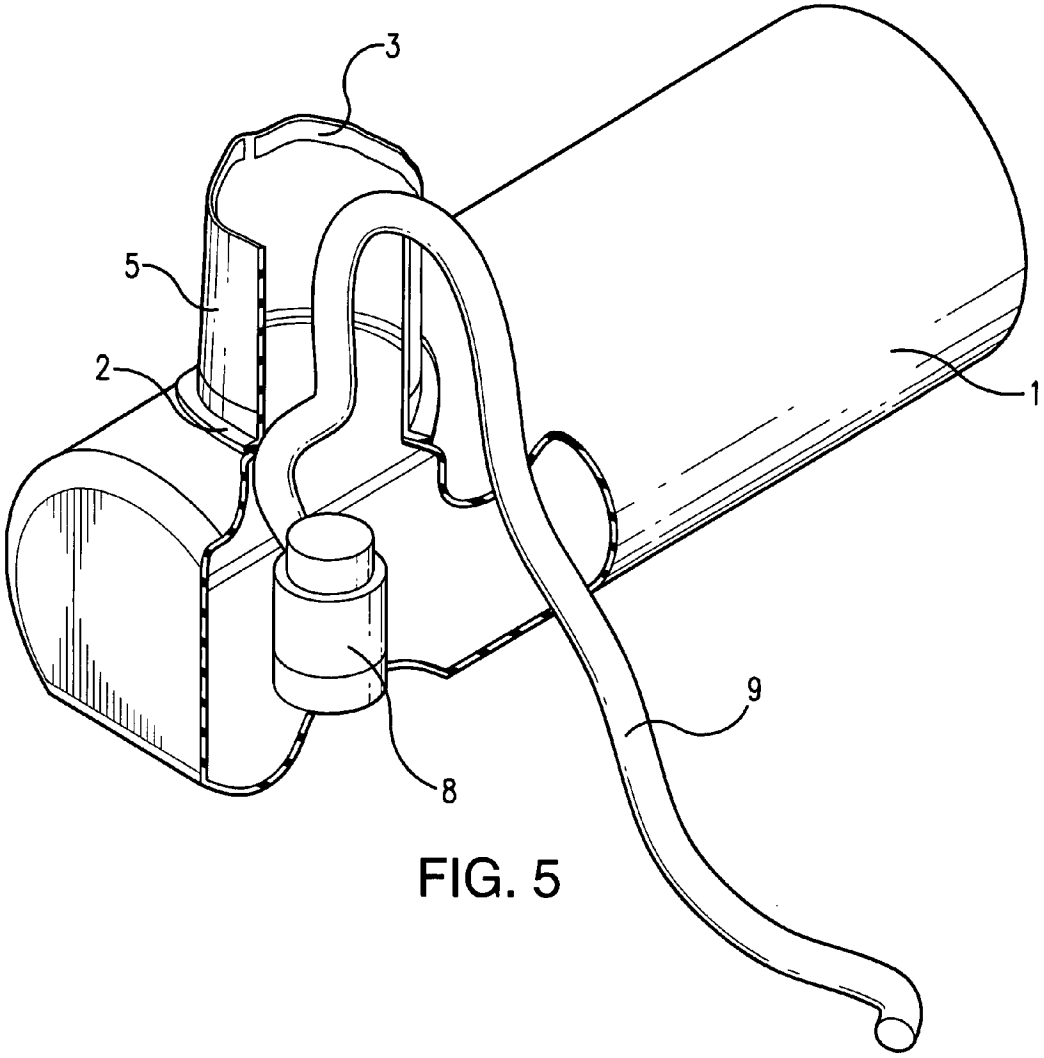
FIG. 5 is an enlarged, perspective view of the embodiment of FIG. 1, with an outer wall of the bladder broken away to reveal the interior thereof.

It is an important feature of my invention that the port 10 is of sufficient size that a pump, indicated by reference numeral 8 in FIGS. 1B and 5, can be positioned within the bladder 1 and, if desired, removed from such a location. In those figures pump 8 is shown as located at the bottom of the bladder in substantial vertical alignment with the port 10 through which the pump has been inserted within the bladder. Pump 8 is a submersible pump that functions in the manner of all such pumps that are conventionally used on boats to clear the bilge of unwanted liquid. Thus, it has been found that submersible bilge pumps such as those marketed by Depco Pump Company, of Clearwater, Fla. as standard bilge pumps and heavy duty bilge pumps, although the former are usually sufficient for pumping water from the bladder of this invention. Such pumps are totally submersible and ignition protected. They can be manually activated or turned on and off by a float switch in a conventional manner. These pumps can pump water at 360 to 1100 gallons per hour, and at higher rates if heavy duty pumps are to be used. As located in the bladder 1, a pump such as that generally indicated by reference numeral 8 is connected to a drain hose 9 that extends through the port 10 when the sleeve 5 is in open position, as will be seen in FIG. 5, and the end of the hose 9 directed to a reservoir or other body of water for discharge.

In the method that encompasses my invention, the bladder 1 is first located in a boat the wake of which is to be enhanced for the sport of water skiing, water boarding and the like. As removed from storage, the bladder, which is formed from a rubbery, resilient material, is limp and light-weight. A submersible pump 8 immersed in a body of water, such as a lake or bay, and activated to pump water through a hose 9 into the interior of the bladder. The hose has a free end that can be inserted through the port 10 past the open sleeve 8 into the interior of the bladder 1. If desired, a nozzle separate from the port can be formed in the bladder as a specific means of egress of water into the bladder, which is then substantially filled with water. With the bladder 1 filled with water, the boat is propelled through the water in a conventional manner and, at moderately high speeds, a wake is created aft of the stern, which wake is augmented due to the weight of the water-filled bladder in the boat.

When the water sport has been terminated and the boat is back at the dock or on its way to the dock, it is desirable that the water be removed from the water-filled bladder as, for example, by siphoning it out or some other, slow, prior art procedure. In the present invention, however, the bladder is emptied of water by a far more expeditious procedure. The resealable sleeve 5 is unsealed and opened, and a submersible pump is inserted through the port 10, past the sleeve 8, and into the interior of the water-filled bladder. When the submersible pump 8 is activated, water is quickly pumped from the interior of the bladder 1 through the hose 9 and into the body of water from which it originated. Alternatively, the water can be directed into the bilge of the boat, from which it can later ejected into the surrounding water. At the dock the pump 8 can be removed from within the bladder 1 and separately stored as the bladder is stored; alternatively, if the boat is to be used soon again for water sports, the pump can be left in position within the bladder and it can remain there as an additional weight to create a stronger wake when the bladder is again filled with water.

Various means can be used to open and close the access port by means of which the submersible pump is inserted within and removed from the bladder 1. In my presently preferred embodiment a flange 2 is located at the base of the sleeve 8, shown in open position in FIG. 5. Flange 2 serves to stabilize the sleeve 5 in open position. As seen in FIGS. 3, 3A and 4, the sleeve 5 can be folded upon itself to create a closure so that water from within the bladder will be maintain therein even during rough weather in which the water within the bladder will splash about. Of course, the seal 11 at the top of the sleeve 8 is adapted to be easily opened and reclosed, such releasable closure being accomplished by any conventional means.

While my invention has been described hereinbefore with reference to a preferred embodiment thereof, it will be apparent to those of skill in this art that many changes and modifications may be made to that preferred embodiment without departing from the spirit of the invention. As to all such obvious alterations and modifications, it is desired that they be included within the purview of my invention, which is to be limited only by the scope, including equivalents, of the following, appended claims.

I claim:

1. A method of emptying liquid from a flexible, portable bladder located at the deck of a boat, said bladder, when filled with liquid, increases the weight applied to said deck so that, when said boat is in motion, the weight of the bladder increases the wake generated by said boat, comprising providing a portable bladder that is substantially liquid impermeable, said bladder having a port formed in an upper surface thereof and a sleeve surrounding said port, said sleeve being movable between a closed position in which it seals said port from the egress of liquid and an open position in which it permits the flow of liquid to and from said bladder, and has a mouth on an upper surface thereof, said mouth being of sufficient size as to permit the ingress and egress of a submersible pump of a capacity of at least 360 gallons per hour into and from said bladder, supplying liquid to said bladder through said sleeve in open position so that the weight of said bladder is increased, locating a submersible pump within said bladder through said sleeve and said bladder port, and activating said submersible pump to evacuate liquid from said bladder when said boat is back at its dock on or on its way back to the dock.

2. A method as claimed in claim 1, in which said submersible pump is a bilge pump.

3. A method as claimed in claim 1, in which said pump removes the liquid from said bladder.

4. A method as claimed in claim 3, which further includes removing said pump from said bladder through said sleeve when said sleeve is in open position and taking said bladder from its location at the deck of said boat and storing it at another location.

5. A method as claimed in claim 4, which includes storing said bladder at another location on said boat.

6. A method as claimed in claim 3, which includes storing said bladder at another location remote from said boat.

* * * * *